US009492024B2

(12) United States Patent
Sorensen et al.

(10) Patent No.: US 9,492,024 B2
(45) Date of Patent: Nov. 15, 2016

(54) STACKABLE CONTAINER SYSTEM

(71) Applicant: Runway Blue, LLC, Lehi, UT (US)

(72) Inventors: Steven M. Sorensen, Alpine, UT (US); Kim L. Sorensen, Alpine, UT (US); David O. Meyers, East Layton, UT (US)

(73) Assignee: RUNWAY BLUE, LLC, Lehi, UT (US)

( * ) Notice: Subject to any disclaimer, the term of this patent is extended or adjusted under 35 U.S.C. 154(b) by 0 days.

(21) Appl. No.: 13/633,864

(22) Filed: Oct. 2, 2012

(65) Prior Publication Data

US 2014/0091086 A1 Apr. 3, 2014

(51) Int. Cl.

| | |
|---|---|
| ***A47G 19/00*** | (2006.01) |
| ***A47G 19/22*** | (2006.01) |
| ***B65D 21/02*** | (2006.01) |
| ***B65D 81/32*** | (2006.01) |

(52) U.S. Cl.

CPC ..... *A47G 19/2205* (2013.01); *B65D 21/0228* (2013.01); *B65D 81/3205* (2013.01)

(58) Field of Classification Search

CPC ..... A47G 19/2205; A47G 19/2255; B65D 21/0228; B65D 21/023; B65D 21/0231; B65D 21/02; B65D 21/0209; B65D 21/0212; B65D 21/0217; B65D 21/0219; B65D 21/022; B65D 21/0222; B65D 21/0223; B65D 81/32; B65D 81/3205

USPC ..... 220/23.83, 23.86, 4.01, 293, 300, 301, 220/298; 215/6; 206/216, 217

See application file for complete search history.

(56) References Cited

U.S. PATENT DOCUMENTS

| | | | |
|---|---|---|---|
| 1,037,051 | A | 8/1912 | Ramsey |
| 1,094,469 | A | 4/1914 | Pick |
| 1,389,732 | A | 9/1921 | Baron |
| 1,479,053 | A | 1/1924 | Brooks |
| 1,573,620 | A | 2/1926 | Allston |
| 2,056,879 | A | 10/1936 | Winterhalter et al. |
| 2,272,867 | A | 2/1942 | Cobel |
| 2,514,573 | A | 7/1950 | Harrison |
| 2,573,378 | A | 10/1951 | Zurlinden |

(Continued)

FOREIGN PATENT DOCUMENTS

| | | |
|---|---|---|
| CN | 201139196 | 10/2008 |
| JP | 2006103793 A | 4/2004 |
| JP | 2008247404 | 10/2008 |

OTHER PUBLICATIONS

U.S. Appl. No. 12/762,292, filed Apr. 16, 2010, Meyers, et al.

(Continued)

*Primary Examiner* — Steven A. Reynolds
*Assistant Examiner* — Javier A Pagan
(74) *Attorney, Agent, or Firm* — Maschoff Brennan

(57) ABSTRACT

The present invention is directed to a stackable container system. The stackable container system can comprise a beverage container, a beverage container lid, a plurality of smaller containers, and a plurality of smaller container lids. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids. In addition to storing beverage ingredients, the stackable container system can also be used to store other edible and inedible ingredients.

21 Claims, 3 Drawing Sheets

(56) References Cited

U.S. PATENT DOCUMENTS

| | | | | |
|---|---|---|---|---|
| 2,574,876 | A | 11/1951 | Lebus | |
| 2,575,299 | A | 11/1951 | Scheel | |
| 2,638,253 | A | 5/1953 | Mueller | |
| 2,748,997 | A | 6/1956 | Richmond, Sr. | |
| 2,752,971 | A | 7/1956 | Tupper | |
| 2,754,866 | A | 7/1956 | Coltman | |
| 3,022,925 | A | 2/1962 | Daniell | |
| 3,091,361 | A | 5/1963 | Gawron | |
| 3,143,205 | A * | 8/1964 | Ruderian | 206/543 |
| 3,144,016 | A | 8/1964 | Basci | |
| 3,168,226 | A | 2/1965 | Underwood | |
| 3,369,691 | A | 2/1968 | Wei | |
| 3,552,548 | A | 1/1971 | Wallestad et al. | |
| 3,770,160 | A | 11/1973 | Flider | |
| 3,820,692 | A | 6/1974 | Swett et al. | |
| D233,116 | S | 10/1974 | Swett et al. | |
| 4,022,352 | A | 5/1977 | Pehr | |
| 4,136,799 | A * | 1/1979 | Albert | 220/298 |
| 4,158,902 | A | 6/1979 | Chernack et al. | |
| D261,088 | S | 10/1981 | Akimov et al. | |
| 4,399,926 | A | 8/1983 | Eidels-Dubovoy | |
| 4,457,458 | A | 7/1984 | Heinol | |
| 4,474,303 | A | 10/1984 | Maccise | |
| 4,519,518 | A | 5/1985 | Wiles et al. | |
| 4,537,044 | A | 8/1985 | Putnam | |
| 4,735,333 | A | 4/1988 | Lay et al. | |
| 4,776,501 | A | 10/1988 | Ostrowsky | |
| 4,805,790 | A | 2/1989 | Leonetti et al. | |
| 4,932,225 | A | 6/1990 | Bighouse | |
| 5,065,877 | A | 11/1991 | Karppinen et al. | |
| 5,065,911 | A | 11/1991 | Rohr et al. | |
| 5,088,614 | A | 2/1992 | Dumestre | |
| D330,862 | S | 11/1992 | Shibley et al. | |
| 5,228,584 | A | 7/1993 | Williams, Jr. | |
| D342,898 | S | 1/1994 | Cane | |
| 5,289,930 | A | 3/1994 | Inouye | |
| D350,460 | S * | 9/1994 | Picozza et al. | D7/629 |
| 5,386,922 | A * | 2/1995 | Jordan | 220/23.83 |
| D356,499 | S | 3/1995 | Cautereels et al. | |
| 5,547,111 | A | 8/1996 | Geiger et al. | |
| 5,609,277 | A | 3/1997 | McDonald | |
| D382,968 | S | 8/1997 | Giles et al. | |
| D404,305 | S | 1/1999 | De Baschmakoff | |
| D405,654 | S | 2/1999 | Moran | |
| D421,547 | S | 3/2000 | Demers | |
| 6,161,713 | A | 12/2000 | Krich | |
| 6,283,333 | B1 | 9/2001 | Knickerbocker et al. | |
| 6,299,005 | B1 | 10/2001 | Higgins | |
| 6,379,032 | B1 | 4/2002 | Sorensen | |
| D458,081 | S | 6/2002 | Bodum | |
| D461,420 | S | 8/2002 | Kerman | |
| D497,431 | S | 10/2004 | Bentley | |
| 6,832,412 | B2 | 12/2004 | Kim | |
| 6,860,397 | B1 | 3/2005 | Walters, Jr. | |
| D504,273 | S | 4/2005 | Ancona | |
| D508,185 | S | 8/2005 | Gauss | |
| D510,235 | S | 10/2005 | Sorensen | |
| D518,336 | S | 4/2006 | Hirani | |
| 7,073,678 | B1 | 7/2006 | Dibdin et al. | |
| D526,827 | S | 8/2006 | Allen et al. | |
| D528,862 | S | 9/2006 | Li | |
| D529,339 | S | 10/2006 | Carreno et al. | |
| D532,650 | S | 11/2006 | de Groote | |
| D543,454 | S | 5/2007 | Leoncavallo et al. | |
| D546,131 | S | 7/2007 | Morales | |
| D547,607 | S | 7/2007 | Forsman | |
| D565,353 | S | 4/2008 | Roth et al. | |
| D574,190 | S | 8/2008 | Homma | |
| D580,227 | S | 11/2008 | Roth et al. | |
| D586,184 | S | 2/2009 | Miller et al. | |
| D587,069 | S | 2/2009 | Bodum | |
| D589,751 | S | 4/2009 | Liu et al. | |
| D592,913 | S | 5/2009 | Pinelli et al. | |
| 7,533,783 | B2 | 5/2009 | Choi et al. | |
| D593,811 | S | 6/2009 | Carreno | |
| D599,664 | S | 9/2009 | Fujinami et al. | |
| D604,103 | S | 11/2009 | Alviar et al. | |
| D609,970 | S | 2/2010 | Richau et al. | |
| D613,110 | S | 4/2010 | Lane et al. | |
| D622,089 | S | 8/2010 | Daniel et al. | |
| D622,554 | S | 8/2010 | Carreno | |
| 7,806,284 | B2 * | 10/2010 | Mangano | 220/4.27 |
| D626,837 | S | 11/2010 | Meyers et al. | |
| D626,838 | S | 11/2010 | Meyers et al. | |
| D628,483 | S | 12/2010 | McKinney et al. | |
| D629,657 | S | 12/2010 | Carreno | |
| 7,870,980 | B2 * | 1/2011 | Wilson et al. | 222/571 |
| D641,594 | S | 7/2011 | Huang | |
| D644,065 | S | 8/2011 | Llerena | |
| 8,020,257 | B2 | 9/2011 | Merten et al. | |
| D646,546 | S | 10/2011 | Robinson et al. | |
| D646,919 | S | 10/2011 | Nilsson | |
| D647,760 | S | 11/2011 | Pearson | |
| D652,256 | S | 1/2012 | Eyal | |
| D655,131 | S | 3/2012 | Nilsson | |
| D655,967 | S | 3/2012 | Bodum | |
| D656,357 | S | 3/2012 | Enghard | |
| D661,551 | S | 6/2012 | Gilbert | |
| D666,047 | S | 8/2012 | Lin | |
| D666,061 | S | 8/2012 | Ying | |
| D667,694 | S | 9/2012 | Meyers et al. | |
| 8,302,796 | B1 * | 11/2012 | Johnson | 220/3.9 |
| 8,342,349 | B2 | 1/2013 | Lu | |
| D677,121 | S | 3/2013 | Meyers et al. | |
| D686,885 | S | 7/2013 | Meyers et al. | |
| D686,886 | S | 7/2013 | Meyers et al. | |
| D686,887 | S | 7/2013 | Meyers et al. | |
| D686,888 | S | 7/2013 | Meyers et al. | |
| 2002/0074334 | A1 * | 6/2002 | Karp | 220/212 |
| 2003/0085228 | A1 * | 5/2003 | Oakes | 220/302 |
| 2004/0217139 | A1 | 11/2004 | Roth et al. | |
| 2004/0262306 | A1 * | 12/2004 | Smith | 220/4.26 |
| 2005/0045634 | A1 | 3/2005 | Ward et al. | |
| 2005/0045636 | A1 | 3/2005 | Lown et al. | |
| 2006/0213912 | A1 * | 9/2006 | Zaytoun | 220/293 |
| 2007/0012693 | A1 * | 1/2007 | Kummer | 220/4.27 |
| 2007/0175931 | A1 | 8/2007 | Leoncavallo et al. | |
| 2008/0099514 | A1 | 5/2008 | Carter et al. | |
| 2009/0178940 | A1 * | 7/2009 | Said | 206/221 |
| 2009/0188884 | A1 * | 7/2009 | Nelson et al. | 215/6 |
| 2009/0188933 | A1 | 7/2009 | Daams | |
| 2009/0301990 | A1 | 12/2009 | Cresswell et al. | |
| 2010/0187235 | A1 | 7/2010 | Chen | |
| 2010/0200438 | A1 * | 8/2010 | Davies | 206/223 |
| 2010/0206835 | A1 | 8/2010 | Yu | |
| 2010/0224631 | A1 | 9/2010 | Roth et al. | |
| 2010/0282703 | A1 | 11/2010 | Yang | |
| 2011/0017760 | A1 | 1/2011 | Newman | |
| 2011/0083300 | A1 | 4/2011 | Heger et al. | |
| 2011/0253733 | A1 | 10/2011 | Meyers et al. | |

OTHER PUBLICATIONS

U.S. Appl. No. 13/232,891, filed Sep. 14, 2011, Meyers, et al.
U.S. Appl. No. 13/232,935, filed Sep. 14, 2011, Meyers, et al.
U.S. Appl. No. 29/430,882, filed Aug. 30, 2012, Meyers, et al.
U.S. Appl. No. 29/431,544, filed Sep. 7, 2012, Meyers, et al.
U.S. Appl. No. 13/609,238, filed Sep. 10, 2012, Meyers, et al.
U.S. Appl. No. 13/610,445, filed Sep. 11, 2012, Meyers, et al.
U.S. Appl. No. 29/457,097, filed Jun. 6, 2013, Sorensen, et al.
U.S. Appl. No. 29/457,096, filed Jun. 6, 2013, Sorensen, et al.
U.S. Appl. No. 61/832,085, filed Jun. 6, 2013, Sorensen, et al.
Kor One, http://www.korwater.com/buyONE, accessed Apr. 21, 2010.
Core 77, http://www.core77.com/blog/materials/kor.sub.--one.sub.--water.su-b.--vessel.sub.--actual.sub.--size.sub.--10211.asp, accessed Apr. 21, 2010.
Koyono, http://www.koyono.com/KOR-ONE-Green-Zen-Water-Hydration-Vessel.sub-.--p/kor-one.htm, accessed Apr. 21, 2010.
Fit Sugar, www.fitsugar.com/2496788, accessed Apr. 21, 2010.
Thermos, http://www.shopthermos.com/detail/TMS+HP4000GR6, accessed Apr. 21, 2010.

(56) References Cited

OTHER PUBLICATIONS

Goodlifter, http://www.goodlifer.com/2009/02/360-paper-water-bottle/, accessed Apr. 21, 2010.
Notice of Allowance from U.S. Appl. No. 29/430,882 dated Aug. 5, 2013.
Advisory Action from U.S. Appl. No. 12/762,292 dated May 24, 2013.
Office Action from U.S. Appl. No. 12/762,292 dated Jul. 1, 2013.
Office Action from U.S. Appl. No. 12/762,292 dated Oct. 2, 2012.
Office Action from U.S. Appl. No. 12/762,292 dated Jul. 17, 2012.
Office Action from U.S. Appl. No. 12/762,292 dated Feb. 10, 2012.
Notice of Allowance from U.S. Appl. No. 29/431,544 dated Aug. 14, 2013.
Office Action from U.S. Appl. No. 29/431,544 dated Mar. 25, 2013.
Office Action from U.S. Appl. No. 13/610,445 dated Mar. 29, 2013.
Office Action from U.S. Appl. No. 13/232,891 dated Jul. 19, 2013.
Office Action from U.S. Appl. No. 13/609,238 dated May 30, 2013.
International Search Report from PCT Application No. PCT/US2011/026508 dated Sep. 29, 2011.
Written Opinion from PCT Application No. PCT/US2011/026508 dated Sep. 29, 2011.
International Preliminary Report on Patentability from PCT Application No. PCT/US2011/026508 dated Oct. 16, 2012.
International Search Report from PCT Application No. PCT/US2012/054483 dated Nov. 16, 2012.
International Search Report and Written Opinion from PCT Application No. PCT/US2012/054497 dated Nov. 20, 2012.
International Search Report and Written Opinion from PCT Application No. PCT/US2013/052132 dated Aug. 16, 2013.
International Search Report and Written Opinion from PCT Application No. PCT/US2013/047161 dated Nov. 20, 2013.
International Preliminary Report on Patentability from PCT Application No. PCT/US2013/052132 dated Apr. 7, 2015.

* cited by examiner

STACKABLE CONTAINER SYSTEM

CROSS-REFERENCE TO RELATED APPLICATIONS

Not Applicable.

BACKGROUND

Beverage bottles or containers have become widely used. Such containers are often used to mix ingredients. For example, many people use these containers to mix nutritional powders into water or another liquid for consumption in conjunction with exercise.

It is often desirable to delay the mixing of the ingredients until an appropriate time. However, because such containers are often used on-the-go, it can be difficult to maintain the ingredients separate until the desired time. For example, some may use multiple containers to store the ingredients of a protein shake until after a workout is finished. Similarly, one or more separate containers may also be used to store supplements, such as vitamins or other pills, which are not mixed in the container.

Keeping track of multiple containers can be burdensome. To address this, some beverage containers have been developed that are configured to allow one or more additional containers to be attached to the beverage container. The additional containers can be used to store ingredients to be mixed in the beverage container at a later time, or to separately store other contents such as pills.

BRIEF SUMMARY

The present invention is directed to a stackable container system. The stackable container system can be used to store ingredients for a beverage, or ingredients or substances for other edible or inedible mixes or purposes.

In one embodiment, a stackable container system of the present invention comprises a beverage container, a beverage container lid, a plurality of smaller containers, and a plurality of smaller container lids. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids.

In another embodiment, a stackable container system of the present invention comprises a beverage container, a beverage container lid, a plurality of smaller containers, a plurality of smaller container lids, and a divider that is sized to be inserted into at least one of the plurality of smaller containers when a smaller container lid is attached to the smaller container. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids.

In another embodiment, the stackable a container system of the present invention comprises a container, a container lid, a plurality of smaller containers, and a plurality of smaller container lids. The bottom of the container is configured to allow the container to be interlocked with the top of any of the at least one smaller container lid when the smaller container lid is secured to one of the at least one smaller container.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

The present invention is directed to a stackable container system. The stackable container system can be used to store ingredients for a beverage, or ingredients or substances for other edible or inedible mixes or purposes.

In one embodiment, a stackable container system of the present invention comprises a beverage container, a beverage container lid, a plurality of smaller containers, and a plurality of smaller container lids. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids.

In another embodiment, a stackable container system of the present invention comprises a beverage container, a beverage container lid, a plurality of smaller containers, a plurality of smaller container lids, and a divider that is sized to be inserted into at least one of the plurality of smaller containers when a smaller container lid is attached to the smaller container. The smaller containers and smaller container lids are configured to allow any of the smaller container lids to be used on any of the smaller containers.

The bottom of the beverage container and the bottom of each smaller container is also configured to allow the beverage container or smaller container to be interlocked with the top of any of the smaller container lids.

In another embodiment, the stackable a container system of the present invention comprises a container, a container lid, a plurality of smaller containers, and a plurality of smaller container lids. The bottom of the container is configured to allow the container to be interlocked with the top of any of the at least one smaller container lid when the smaller container lid is secured to one of the at least one smaller container.

Figure 1:
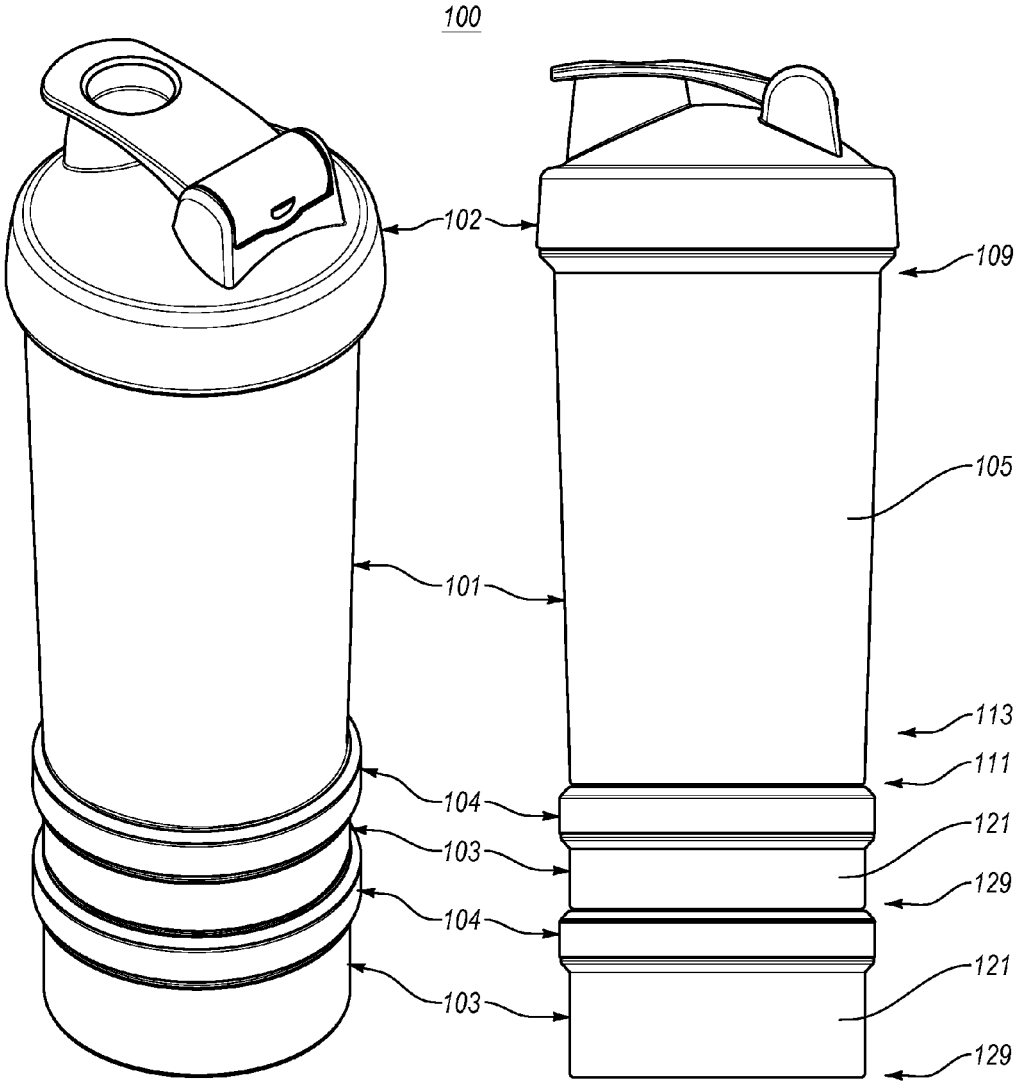
FIG. 1 illustrates two views of a stackable container system according to one or more embodiments of the invention.

FIG. 1 illustrates two views of a stackable container system 100 in accordance with one or more embodiments of the invention. As shown, stackable container system 100 includes a beverage container 101 with a beverage container lid 102, and two smaller containers 103 that each includes a lid 104.

Although stackable container system 100 is shown having two smaller containers with lids, in some embodiments, a stackable container system can have one or more smaller containers with lids that interconnect with beverage container 101. Further, the stackable container system of the present invention is not limited to any particular type of beverage container and beverage container lid such as those shown in FIG. 1. For example, a beverage container and beverage container lid in some embodiments of the stackable container system can be a baby bottle and nipple or another type of bottle and lid for containing and/or dispensing any type of beverage or pourable substance.

Figure 2:
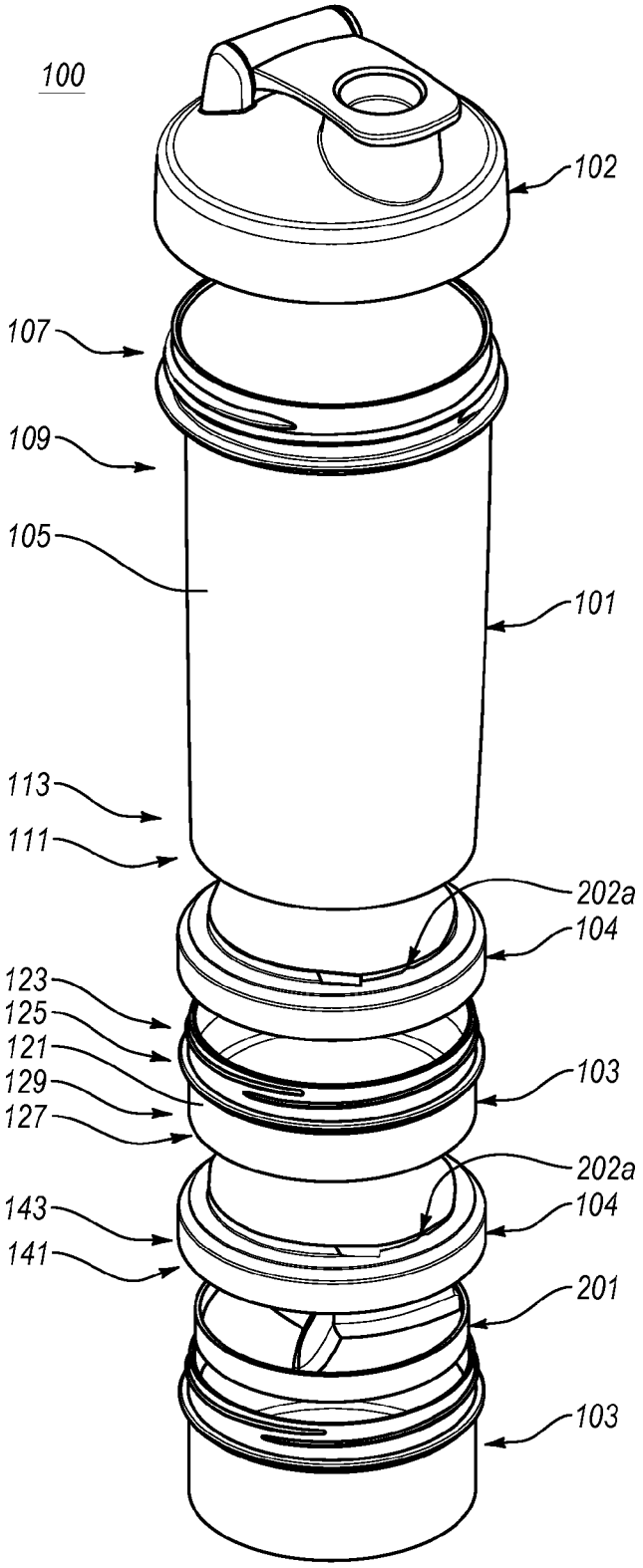
FIG. 2 illustrates an exploded view of the stackable container system of FIG. 1.

Each of lids 104 can be attached to either of smaller containers 103 (e.g. via threads (either on the inside or outside of smaller containers 103) as shown in FIG. 2 or other means as known in the art). The top of each of lids 104 is also configured to allow lid 104 to be attached to the bottom of beverage container 101 or either of smaller containers 103. In this manner, with lids 104 secured to smaller containers 103, smaller containers 103 and beverage container 101 can be interconnected to form a stack as shown in FIG. 1.

Because each container (beverage container 101 and smaller containers 103) includes a separate lid (beverage container lid 102 and lids 104), each container is independently sealable. In other words, stackable container system 100 comprises three containers that can each be sealed and used independently of the other containers, while still being interconnectable to form a single stackable container system.

FIG. 2 illustrates an exploded view of stackable container system 100. In addition to the components shown in FIG. 1, FIG. 2 also illustrates that stackable container system 100 can include a divider 201. Divider 201 can be configured to be inserted into one or more of smaller containers 103. The stackable container system of the present invention can include a single divider 201 (which may be inserted into one or more of the smaller containers), or more than one divider 201 (which may each be inserted into any of the smaller containers or which may each be configured to be inserted into a single specific smaller container).

Divider 201 is shown as having a base and three compartments. Accordingly, divider 201 provides three separate compartments for storing ingredients, pills, or other items as desired. Of course, a divider having fewer or more than three compartments could also be provided.

In some embodiments, each smaller container 103 that is configured to store divider 201 can include means for supporting divider 201. In some embodiments, this means can include a lip that extends around the inside wall of smaller container 103 on top of which divider 201 rests. One benefit of configuring smaller container 103 with a lip or other means for supporting divider 201 is that a space can be maintained within smaller container 103 and below divider 201 when divider 201 is inserted into smaller container 103. In other words, when a divider 201 providing three compartments is used, four separate compartments can be formed within smaller container 103 (one below divider 201 and three above (or within) divider 201).

Divider 201 can be configured to have a different depth than is shown in FIG. 2. In other words, the distance between the base and the top of divider 201 can be greater than or less than the distance shown in FIG. 2. Also, in some embodiments, divider 201 can be configured without a base in which case divider 201 can be placed in contact with the inside bottom surface of container 103 such that the inside bottom surface acts as a base for divider 201.

FIG. 2 also illustrates that lids 104 can be interconnected with the bottom of beverage container 101 or the bottom of a smaller container 103 using a bayonet mount. Although a bayonet mount is shown in FIG. 2, any type of connection can be used to secure lids 104 to the bottom of smaller containers 103 or beverage container 101 including by threading, snapping, twisting, sliding, or screwing lids 104 onto the bottom of the containers 101, 103.

Figure 3:
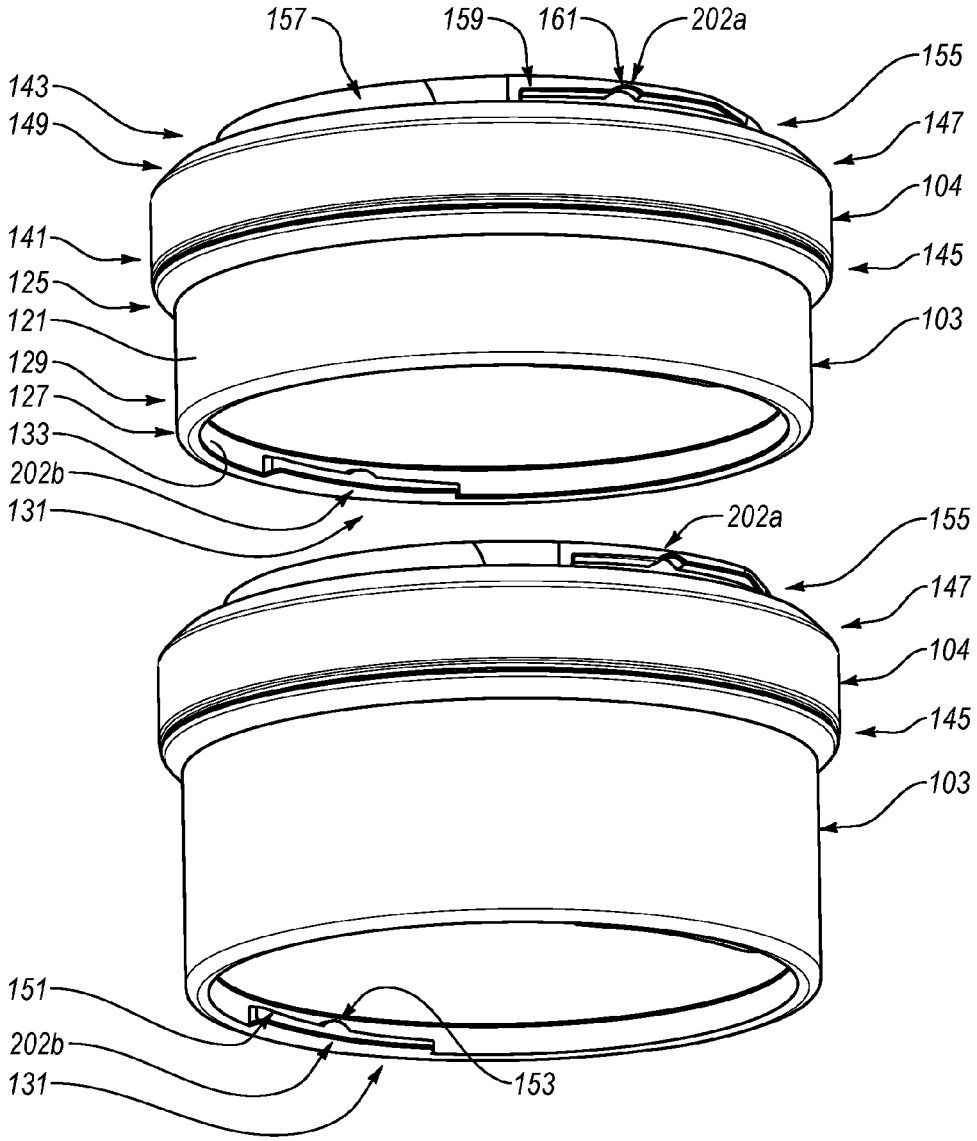
FIG. 3 illustrates an exploded view of two smaller containers with smaller container lids according to one or more embodiments of the invention.

In FIG. 2, a female side 202*a* of the bayonet mount is shown as being formed within the top surface of lids 104. As shown in FIG. 3, a corresponding male portion 202*b* of the bayonet mount can be formed within the bottom of smaller containers 103. A similar male portion can also be formed within the bottom of beverage container 101. Male portion 202*b* can be twisted into female portion 202*a* to lock a lid to the bottom of a container.

In some embodiments, the female and male portions 202*a*, 202*b* of the bayonet mount can be universal thus allowing any lid 104 to be connected to the bottom of any of beverage container 101 and smaller containers 103. Further, the male and female portions could be equally formed on the top of lids 104 and the bottom of the containers respectively. However, one benefit of forming the male portion on the bottom of the containers is that it can allow a less rigid material to be used for lids 104.

The stackable container system of the present invention can be used to store ingredients separately until the user desires to mix the ingredients. For example, a user can put ingredients for a protein shake in smaller containers 103 (with or without using divider 201). Once the user desires to mix the protein shake, he can remove smaller containers 103 to add their contents to beverage container 101, add liquid if necessary to beverage container 101, and mix the contents within beverage container 101.

In greater detail, as shown in FIGS. 1-3, the stackable container system 100 may include a beverage container 101. The beverage container 101 may include a body, such as a beverage container body 105, and a portion that is sized and configured to be connected to a lid, such as a beverage container lid connecting portion 107. The beverage container lid connecting portion 107 may be disposed at least proximate an upper portion 109 of the beverage container body 105. The beverage container 101 may also include an annular flange 111 and the flange may extend downwardly from a lower portion 113 of the beverage container body 105. In addition, the beverage container 101 may include a lid connecting portion disposed on an interior wall of the annular flange 111 of the beverage container body 105. The beverage container lid 102 may be selectively attached to the beverage container lid connecting portion 107. The system 100 may include one or more, such as a plurality, of smaller containers 103 and the smaller containers may be sized and configured to be interchangeably connected to the beverage container 101 and other smaller containers 103. The smaller containers 103 may include a smaller container body 121, a threaded connecting portion 123 disposed at least proximate an upper portion 125 of the smaller container body 121, an annular flange 127 extending downwardly from a lower portion 129 of the smaller container body 121, and a lid connecting portion 131 disposed on an interior wall 133 of the annular flange 127 of the smaller container body 121. The system 100 may include one or more, such as a plurality, of the smaller container lids 104 and the smaller container lids may be sized and configured to be selectively attached to the threaded connecting portion 123 of the smaller containers 103. The smaller container lids 104 may include a first connecting structure 141, such as an annular flange, that is sized and configured to be attached to the threaded connecting portion 123 of the smaller containers 103. The smaller container lids 104 may further include a second connecting structure 143, such as a container connecting portion, and the second connecting structure may be interchangeably connectable to the lid connecting portion 131 of the smaller container 103 (which may be referred to as smaller container lid connecting portion) and the lid connecting portion of the beverage container 101.

As shown in the accompanying figures, the stackable container system 100 may include the beverage container 101 and the beverage container may include the body 105, the beverage container lid connecting portion 107, which may be disposed at least proximate the upper portion 109 of the beverage container body 105, the annular flange 111 extending downwardly from the lower portion 113 of the beverage container body 105, and the lid connecting portion disposed on the interior portion of the annular flange 111 of the beverage container body 105. The beverage container lid 102 may be connected to the beverage container lid connecting portion 107 of the beverage container 101. The one or more, or plurality, of the smaller containers 103 may be sized and configured to be interchangeably connected to the beverage container 101 and other smaller containers. Each smaller container 103 of the plurality of smaller containers may include the smaller container body 121, the threaded connecting portion 123 disposed at least proximate the upper portion 125 of the smaller container body 121, the annular flange 127 extending downwardly from the lower portion 129 of the smaller container body 121, and the lid connecting portion 131 disposed on the interior portion 133 of the annular flange 127 of the smaller container body 121. The system 100 may include a plurality of the smaller container lids 104 and the smaller container lids may be sized and configured to be selectively attached to the threaded connecting portion 123 of the smaller containers 103. The smaller container lids 104 may include the first connecting structure 141, which may be sized and configured to interchangeably connect the lid to one of the smaller containers 103, and a second connecting structure 143, which may be sized and configured to connect the smaller container lid 104 to one of the smaller containers 103 or the beverage container 101. The first connecting structure 141 may be disposed on a first side 145 of the lid 104 and the second connecting structure 143 disposed on a second side 147 of the lid 104, and a central portion 149, such as an annular ring or tapered portion, may be disposed between the first connecting structure on the first side of the lid and the second connecting structure on the second side of the lid. Additionally, the first connecting structure 141 may be a different type of connecting structure than the second connecting structure 143.

As discussed above, FIGS. 1-3 show the stackable container system 100 may include a beverage container 101. The beverage container 101 may include the body 105, the annular flange 111 extending downwardly from the lower portion 113 of the body 105, and the lid connecting portion on the inner surface of the annular flange 111. The system 100 may also include a plurality of the smaller containers 103 and the smaller containers may be sized and configured to be interchangeably connected to the beverage container 101 and/or other smaller containers 103. The smaller containers 103 may include the body 121, the annular flange 127 extending downwardly from the lower portion 129 of the body 121, and the smaller container lid connecting portion 131 extending inwardly from the inner surface 133 of the annular flange 127 of the smaller container body 121. The system 100 may further include a plurality of the smaller container lids 104. The smaller container lids 104 may be sized and configured to interchangeably connect the smaller containers 103 and/or interchangeably connect the smaller containers 103 to the beverage container 101. The smaller container lid 104 may include the first connecting structure 141, which may be sized and configured to be connected to the upper portion 125 of the smaller container body 121. The smaller container lid 104 may include the second connecting structure 143, which may be sized and configured to be connected to the smaller container lid connecting portion 131 of the smaller containers 103 and the lid connecting portion of the beverage container 101. The smaller container lid connecting portion 131 may include a base 151 and an engaging member 153. The base 151 may extend inwardly from the inner surface 133 of the annular flange 127 and the base may include a planar lower surface that is generally aligned and disposed in the same plane as the lower surface of the annular flange. The base 151 may also form an inwardly extending portion or protrusion from the inner surface of 133 of the annular flange 127 of the smaller container body 121. An upper surface of the base 151 may be tapered or angled, and the engaging member 153 may be centrally disposed on the upper surface of the base. For example, as shown in FIG. 3, the engaging portion 153 may form a centrally disposed dome-shaped protrusion on the upper surface of the base 151. A receiving portion 155 of the second connecting structure 143 of the smaller container lid 104 may be sized and configured to receive at least a portion of the base 151 and the engaging member 153 when, for example, the smaller container lid 104 is connected to a smaller container 103. In addition, the lid connecting portion of the beverage container 101 and the lid connecting portion 131 of the smaller container 103 may be at least partially disposed in the receiving portion 155 of the second connecting structure 143 when the smaller container lid 104 is connected to the beverage container 101 or the smaller container 103. As shown in FIGS. 2 and 3, the receiving portion 155 of the second connecting structure 143 of the smaller container lid 104 may have the configuration of a slot, space or opening. When the base 151 is at least partially disposed in the receiving portion 155 and the engaging member 153 is at least partially disposed in the receiving portion 161, the upper portion of the smaller container lid 104 may be connected to the lid connecting portion of the beverage container 101 or the smaller container lid connecting portion 131. This type of connection may be referred to as a bayonet-type connection.

As seen in FIGS. 2-3, the system 100 may include a plurality of the smaller container lids 104 that may be sized and configured to interchangeably connect the smaller containers 103 and/or interchangeably connect the smaller containers 103 to the beverage container 101. As previously discussed, the smaller container lid 104 may include the second connecting structure 143, such as upwardly extending connecting portion, that is sized and configured to be selectively connected to the lid connecting portion 131 of the smaller containers 103 and the lid connecting portion of the beverage container 101. In addition, as previously mentioned, the upwardly extending connecting portion of the second connecting structure 143 may form part of the female portion of the mount 202*a* and the smaller container lid connecting portion 131 may form part of the male portion of the mount 202*b*. In greater detail, for example, the upwardly extending connecting portion 143 may include an outer wall 157 and the female portion of the mount 202*a* may include a flange 159 that extends outwardly from the outer wall. A lower portion of the flange 159 may include the receiving portion 161, such as a recess, groove, or indentation. As shown in FIGS. 2 and 3, the receiving portion 161 may have a generally semi-circular configuration and it may be generally centered along a length of the lower portion of the flange 159.

The male portion of the mount 202*b* is preferably complementary to the female portion of the mount 202*a*. For instance, as shown in the accompanying figures, the male portion of the mount 202*b* may include an inwardly extending flange 151 on the interior wall 133 of the annular flange 127. The inwardly extending flange 151 may include engaging portion 153, such as a projection, protrusion, or protuberance. The engaging portion 153 on the inwardly extending flange 151 of the male portion of the mount 202*b* is preferably sized and configured to be at least partially disposed in the receiving portion 161 of the outwardly extending flange 159 of the female portion of the mount 202*a*, when the lid 104 is connected to the smaller container 103 or the beverage container 101. In greater detail, the male portion of the mount 202*b* may be at least partially disposed in the female portion of the mount 202*a*, and the female portion of the mount 202*a* and/or the male portion of the mount 202*b* may be rotated or moved so that the engaging portion 153 on the inwardly extending flange 151 of the male portion of the mount is at least partially disposed in the receiving portion 161 of the outwardly extending flange 159 of the female portion of the mount. Advantageously, this may allow the smaller container lid 104 to be securely and selectively attached to the beverage container 101 or a smaller container 103. In addition, when the engaging portion 153 on the inwardly extending flange 151 of the male portion of the mount 202*b* is at least partially disposed in the receiving portion 161 of the outwardly extending flange 159 of the female portion of the mount 202*a*, the outwardly extending flange of the female portion of the mount may at least partially abut the inwardly extending flange of the male portion of the mount.

As illustrated in FIGS. 2 and 3, for example, the stackable container system may include a beverage container 101, a beverage container lid 102, a plurality of smaller containers 103, and a plurality of smaller container lids 104. In greater detail, the beverage container 101 may include the beverage container body 105; the beverage container lid connecting portion 107 disposed at least proximate the upper portion 109 of the beverage container body 105; the annular flange 111 extending downwardly from the lower portion 113 of the beverage container body 105; and the lid connecting portion disposed on the interior wall of the annular flange 111 of the beverage container body 105. The beverage container lid 102 may be selectively attached to the beverage container lid connecting portion 107. The plurality of smaller containers 103 may be sized and configured to be interchangeably connected to the beverage container 101 and other smaller containers 103. Each of the smaller containers 103 of the plurality of smaller containers may include the smaller container body 121; the threaded connecting portion 123 disposed at least proximate the upper portion 125 of the smaller container body 121; the annular flange 127 extending downwardly from the lower portion 129 of the smaller container body 121; and the lid connecting portion 131 disposed on the interior wall 133 of the annular flange 127 of the smaller container body 121. The plurality of smaller container lids 104 may be sized and configured to be selectively attached to the threaded connecting portion 123 of the smaller containers 103. Each of the smaller container lids 104 of the plurality of smaller container lids may include the annular flange 127 sized and configured to be attached to the threaded connecting portion 123 of the smaller containers 103; and the container connecting portion 143 that is interchangeably connectable to the lid connecting portion 131 member of the smaller container 103 and the lid connecting portion member of the beverage container 101. Additionally, the container connecting portion 143 of the smaller container lids 104 may include an outwardly extending flange 159 and a receiving portion 161 disposed in the outwardly extending flange, which may be part of the female portion of the mount 202*a*. The lid connecting portion of the beverage container 101 and the lid connecting portion of the smaller containers 103 may include an inwardly extending flange 151 and an engaging portion 153, which may be part of the male portion of the mount 202*b*. In addition, the outwardly extending flange 159 of the container connecting portion 143 of the smaller container lids 104 may at least partially abut the inwardly extending flange 151 of the lid connecting portion 131. Further, the engaging portion 153 of the lid connecting portion of the beverage container 101 and the lid connecting portion 131 of the smaller containers 103 may be at least partially disposed in the receiving portion 155 of the container connecting portion of the smaller container lids. Advantageously, this may allow the beverage container 101, smaller containers 103 and lids 104 to be selectively connected in various combinations and arrangements.

The stackable container system can also be used to store ingredients for and later mix the ingredients for any type of beverage or pourable substance such as, for example, baby formula, ingredients for salad dressing, ingredients for pancake batter, nutritional drink mixes, ingredients for inedible substances (e.g. paints), etc. Accordingly, the stackable container system should not be limited to any particular use (including to uses for mixing edible substances), but should extend to a stackable container system for storing and/or mixing ingredients whether the ingredients are for a beverage or other edible mix or for an inedible mix.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A stackable container system comprising:

a beverage container comprising:

a beverage container body;

a beverage container lid connecting portion disposed at least proximate an upper portion of the beverage container body;

an annular flange extending downwardly from a lower portion of the beverage container body; and a smaller container lid connecting portion disposed on an interior wall of the annular flange of the beverage container body;

a beverage container lid selectively attached to the beverage container lid connecting portion;

a plurality of smaller containers sized and configured to be interchangeably connected to the beverage container and other smaller containers, each smaller container of the plurality of smaller containers comprising:

a smaller container body;

a threaded connecting portion disposed at least proximate an upper portion of the smaller container body;

an annular flange extending downwardly from a lower portion of the smaller container body; and a smaller container lid connecting portion disposed on an interior wall of the annular flange of the smaller container body; and a plurality of smaller container lids sized and configured to be selectively attached to the threaded connecting portion of the smaller containers, each smaller container lid of the plurality of smaller container lids comprising:

a first connecting structure on a first side of the smaller container lid, the first connecting structure comprising a threaded connecting portion that is interchangeably connectable to the threaded connecting portion of the smaller containers;

a second connecting structure on a second side of the smaller container lid, the second connecting structure comprising an annular flange sized and configured to be attached to the smaller container lid connecting portion of the beverage container or the smaller container lid connecting portion of the smaller container, the second connecting structure comprising an upwardly curved receiving portion disposed in a lower surface of the annular flange; and a central portion disposed between the first connecting structure and the second connecting structure;

wherein the smaller container lid connecting portion of the beverage container and the smaller container lid connecting portion of the smaller containers comprises an inwardly extending flange and an upwardly curved engaging portion disposed in an upper surface of the inwardly extending flange, the upwardly curved engaging portion have a centrally disposed dome shaped protrusion, the upwardly curved engaging portion complementary to the upwardly curved receiving portion in the lower surface of the outwardly extending flange;

wherein the flange of the second connecting structure of the smaller container lid at least partially abuts the inwardly extending flange of the smaller container lid connecting portion when the smaller container lid is connected to a smaller container; and wherein the lid connecting portion of the beverage container and the smaller container lid connecting portion is at least partially disposed in the receiving portion of the container connecting portion of the smaller container lids.

2. The stackable container system as in claim 1, wherein the smaller container lid connecting portion of the beverage container and the lid connecting portion of the smaller container are substantially identical to allow the smaller container lid to be interchangeably attached to the smaller containers and the beverage container.

3. The stackable container system as in claim 1, wherein the smaller container lid connecting portion of the beverage container and the lid connecting portion of the smaller container comprise a male connector.

4. The stackable container system as in claim 1, wherein the smaller container lid connecting portion of the beverage container and the lid connecting portion of the smaller container comprise an inwardly extending protrusion and an engaging portion.

5. The stackable container system as in claim 1, wherein the smaller container lid connecting portion of the beverage container and the lid connecting portion of the smaller container comprise a bayonet mount.

6. The stackable container system as in claim 1, wherein the second connecting structure on the second side of the smaller container lid comprises a female connector.

7. The stackable container system as in claim 1, wherein the second connecting structure on the second side of the smaller container lid comprises a slot and a receiving portion.

8. The stackable container system as in claim 1, wherein the smaller container lid connecting portion of the beverage container comprises a bayonet mount.

9. The stackable container system as in claim 1, further comprising a divider disposed in one or more of the smaller containers, the divider dividing the smaller container into multiple compartments.

10. The stackable container system as in claim 1, wherein any smaller container lids can be interchangeably attached to any of the plurality of smaller containers and the smaller container lid connecting portion of the beverage container.

11. The stackable container system as in claim 1, wherein the smaller container lid connecting portion of the beverage container and the lid connecting portions of the smaller container comprise an inwardly extending protrusion and an engaging portion; and wherein the container connecting portion of the smaller container lid comprises a slot and a receiving portion.

12. A stackable container system comprising:

a beverage container comprising:

a beverage container body;

a threaded connecting portion disposed at least proximate an upper portion of the beverage container body;

an annular flange extending downwardly from a lower portion of the beverage container body; and a smaller container lid connecting portion disposed on an interior portion of the annular flange of the beverage container body;

a beverage container lid attached to the threaded connecting portion of the beverage container;

a plurality of smaller containers sized and configured to be interchangeably connected to the beverage container and other smaller containers, each smaller container of the plurality of smaller containers comprising:

a smaller container body;

a threaded connecting portion disposed at least proximate an upper portion of the smaller container body;

an annular flange extending downwardly from a lower portion of the smaller container body; and a smaller container lid connecting portion disposed on an interior portion of the annular flange of the smaller container body; and a plurality of smaller container lids sized and configured to be selectively attached to the threaded connecting portion of the smaller containers, each smaller container lid of the plurality of smaller container lids comprising:

a first connecting structure disposed on a first side of the smaller container lid, the first connecting structure sized and configured to interchangeably connect the lid to the smaller container;

a second connecting structure disposed on a second side of the smaller container lid, the second connecting structure sized and configured to connect the smaller container lid to the smaller container or the beverage container, the first connecting structure a different type of connecting structure than the second connecting structure; and a central portion disposed between the first connecting structure and the second connecting structure;

wherein the second connecting structure on the second side of the smaller container lids comprises an outwardly extending flange and an upwardly curved receiving portion disposed in a lower surface of the outwardly extending flange;

wherein the smaller container lid connecting portion of the beverage container and the lid connecting portion of the smaller containers comprises an inwardly extending flange and an upwardly curved engaging portion disposed in an upper surface of the inwardly extending flange, the upwardly curved engaging portion have a centrally disposed dome shaped protrusion, the upwardly curved engaging portion complementary to the upwardly curved receiving portion in the lower surface of the outwardly extending flange;

wherein the outwardly extending flange of the container connecting portion of the smaller container lids at least partially abuts the inwardly extending flange of the lid connecting portion; and wherein the engaging portion of the smaller container lid connecting portion of the beverage container and the lid connecting portion of the smaller containers is at least partially disposed in the receiving portion of the container connecting portion of the smaller container lids when the smaller container lid is connected to a smaller container.

13. The stackable container system as in claim 12, wherein the smaller container lid connecting portion of the beverage container and the lid connecting portion of the smaller container are substantially identical to allow the smaller container lid to be interchangeably attached to the smaller containers and the beverage container.

14. The stackable container system as in claim 12, wherein the smaller container lid connecting portion of the beverage container and the lid connecting portion of the smaller container comprise an inwardly extending protrusion and an engaging portion; and wherein the container connecting portion of the smaller container lid comprises a slot and a receiving portion.

15. A stackable container system comprising:

a beverage container comprising:

a beverage container body;

an annular flange extending downwardly from a lower portion of the beverage container body; and a lid connecting member extending inwardly from an inner surface of the annular flange;

a plurality of smaller containers sized and configured to be interchangeably connected to the beverage container and other smaller containers, each smaller container of the plurality of smaller containers comprising:

a smaller container body;

an annular flange extending downwardly from a lower portion of the smaller container body; and a lid connecting member extending inwardly from an inner surface of the annular flange of the smaller container body; and a plurality of smaller container lids, each smaller container lid of the plurality of smaller container lids sized and configured to interchangeably connect the smaller containers and interchangeably connect the smaller containers to the beverage container, the smaller container lid comprising:

a downwardly extending annular flange;

a smaller container connecting portion on an inner surface of the downwardly extending annular flange that is sized and configured to be connected to an upper portion of the smaller containers;

an upwardly extending connecting portion sized and configured to be connected to the lid connecting member of the smaller containers and the lid connecting member of the beverage container; and a receiving portion of the upwardly extending connecting portion;

wherein the lid connecting member of the beverage container and the lid connecting member of the smaller container is at least partially disposed in the receiving portion of the upwardly extending connecting portion when the smaller container lid is connected to the beverage container or the smaller container;

wherein the smaller container connecting portion of the smaller container lid comprises an outwardly extending flange and an upwardly curved receiving portion disposed in a lower surface of the outwardly extending flange;

wherein the lid connecting member of the beverage container and the lid connecting member of the smaller containers comprises an inwardly extending flange and an upwardly curved engaging portion disposed in an upper surface of the inwardly extending flange, the upwardly curved engaging portion have a centrally disposed dome shaped protrusion, the upwardly curved engaging portion complementary to the upwardly curved receiving portion in the lower surface of the outwardly extending flange;

wherein the outwardly extending flange of the container connecting portion of the smaller container lids at least partially abuts the inwardly extending flange of the lid connecting member; and wherein the engaging portion of the lid connecting member of the beverage container and the lid connecting member of the smaller containers is at least partially disposed in the receiving portion of the container connecting portion of the smaller container lids.

16. The stackable container system as in claim 15, wherein the lid connecting member extending inwardly from an inner surface of the annular flange of the beverage container is substantially identical to the lid connecting member extending inwardly from an inner surface of the annular flange of the smaller container.

17. The stackable container system as in claim 15, wherein the lid connecting member of the beverage container and the lid connecting member of the smaller container comprise an inwardly extending protrusion and an engaging portion; and wherein the smaller container connecting portion comprises a slot and a receiving portion.

18. The stackable container system as in claim 15, wherein the plurality of smaller containers and the plurality of smaller container lids have substantially the same outer diameter.

19. The stackable container system as in claim 15, wherein and the plurality of smaller containers, the plurality of smaller container lids, and the lower portion of the beverage container have substantially the same outer diameter.

20. The stackable container system as in claim 15, wherein the lower portion of the beverage container and the plurality of small container lids have substantially the same outer diameter.

21. The stackable container system as in claim 15, wherein the lower portion of the beverage container and the plurality of small container have substantially the same outer diameter.

* * * * *